US009033539B2

(12) United States Patent
Chien

(10) Patent No.: US 9,033,539 B2
(45) Date of Patent: May 19, 2015

(54) LED DEVICE HAS BUILT-IN REMOVABLE LED-LIGHTS

(76) Inventor: Tseng-Lu Chien, Walnut, CA (US)

( * ) Notice: Subject to any disclaimer, the term of this patent is extended or adjusted under 35 U.S.C. 154(b) by 117 days.

(21) Appl. No.: 13/402,247

(22) Filed: Feb. 22, 2012

(65) Prior Publication Data

US 2013/0215603 A1 Aug. 22, 2013

(51) Int. Cl.
*F21L 4/08* (2006.01)
*F21V 19/00* (2006.01)

(52) U.S. Cl.
CPC ..... *F21V 19/001* (2013.01)

(58) Field of Classification Search
USPC ..... 362/183, 642, 276, 20, 184
IPC ..... F21L 4/027; F21S 8/035
See application file for complete search history.

(56) References Cited

U.S. PATENT DOCUMENTS

| | | | | |
|---|---|---|---|---|
| 4,428,033 | A * | 1/1984 | McBride | 362/183 |
| 5,645,341 | A * | 7/1997 | Liao | 362/183 |
| 5,806,961 | A * | 9/1998 | Dalton et al. | 362/183 |
| 7,722,230 | B2 * | 5/2010 | Chien | 362/382 |
| 7,819,546 | B1 * | 10/2010 | Kazmerowski et al. | 362/184 |
| 8,076,855 | B2 * | 12/2011 | Wallach et al. | 315/86 |
| 8,508,156 | B2 * | 8/2013 | Tsai | 315/307 |
| 2009/0180271 | A1 * | 7/2009 | Jachmann | 362/20 |
| 2013/0076269 | A1 * | 3/2013 | Shilton | 315/360 |
| 2013/0194789 | A1 * | 8/2013 | Vargas | 362/183 |

* cited by examiner

*Primary Examiner* — Peggy Neils
(74) *Attorney, Agent, or Firm* — Bacon & Thomas, PLLC

(57) ABSTRACT

An LED device includes a main object with at least one built-in removable LED-unit. The main object has its own illumination function or functions, and the at least one removable LED-unit also has its own illumination function. This allows the LED device to provide illumination, for example, both during a power failure, emergency, or hazard condition, and also for daily use purposes.

9 Claims, 6 Drawing Sheets

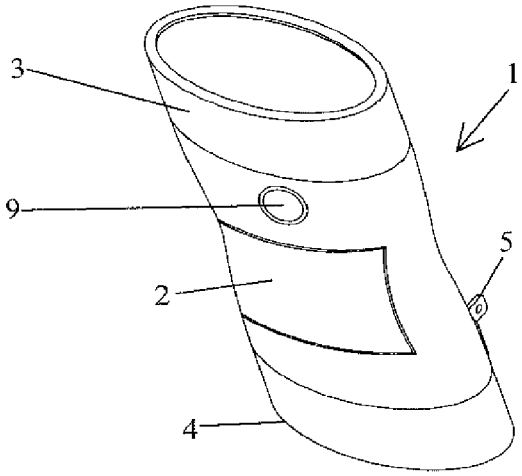
Fig 1
Fig 2
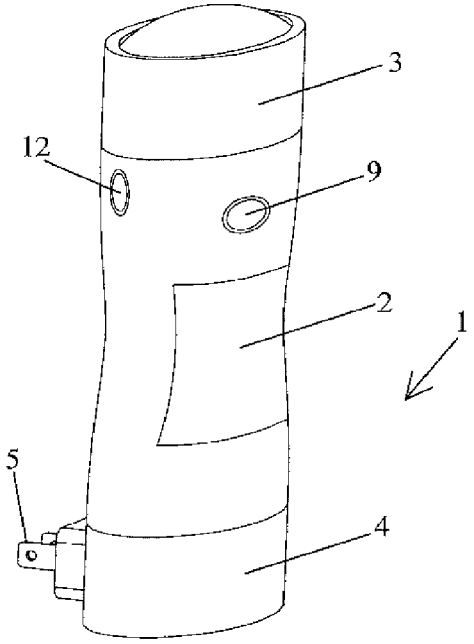

Fig 5
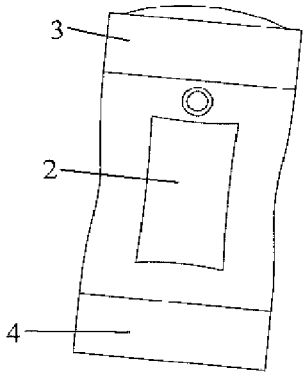
Fig 6
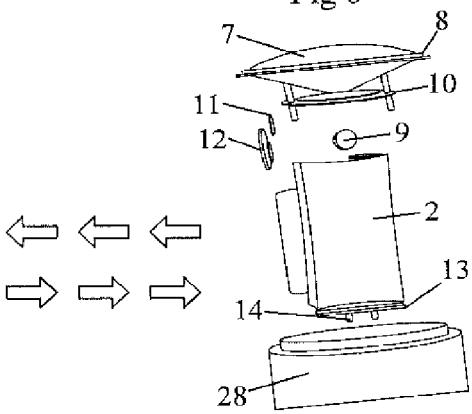
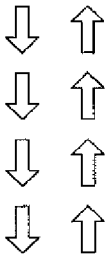
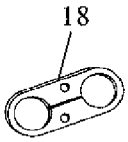
Fig 8
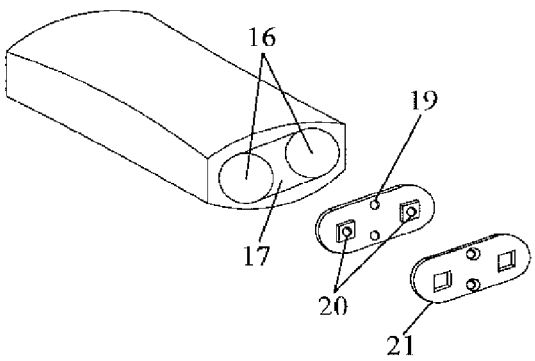
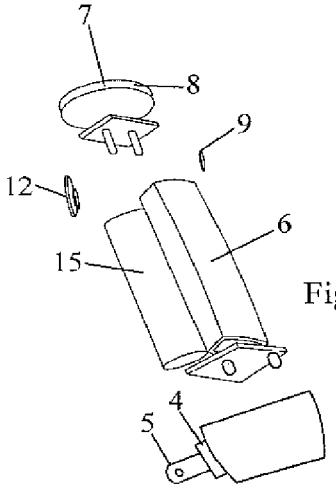
Fig 7

3
18
5

3
15
4
5

7
8
10
11
12
9
13
14
28

7
3
15
13
14
5
4

7
8
9
12
6
15
4
5
28

LED DEVICE HAS BUILT-IN REMOVABLE LED-LIGHTS

BACKGROUND OF THE INVENTION

This application has subject matter in common with the inventor's U.S. Pat. No. 8,083,376 to an LED power failure light, U.S. Pat. No. 6,179,431 to an EL flash light, U.S. patent application Ser. No. 12/938,628 to an LED light fixture having outlets and removable LED units, and U.S. Pat. No. 8,083,392, to an LED light having removable self-powered LED units.

Currently available types of LED light include a flash light, power fail light, light bar, and light device having LED-elements as a light source to replace out-of-date incandescent bulbs for less power consumption, compact size, long burn-time, durability, and so forth. To take advantage of the power saving, compact size, and longer burn-time of the LED light as a replacement for out-of-date incandescent bulbs, the size of the LED flashlight, power fail light, light bar, and/or light device has become very small. All of these categories of products in the market have become very compact—as small as cigarette lighter size or miniature hot-dog size. However, these tiny LED flashlights, power fail lights, or light bars, or other LED devices are not what people want to use.

Instead, in the categories of flashlight, power fail light, light bar, and other LED device, people still want the old bulky size of flashlight, power fail light, light bar, or other LED device, just as home phones have kept the same size rather than being reduced to miniature hot-dog size because people's head size from ear to mouth has not changed. Similarly, traditionally larger sized flash lights, power fail lights, and light bars fit for people's hand size and are good for palm holding, allowing people to feel safe while using these devices in an emergency or hazardous situation. The categories of flash light, power fail light, and light bar still evoke traditional images deep inside human memory, and so it is not at all good to make such devices in a compact size.

The current invention applies an LED element or elements as a light source to benefit from power saving, long burn-time, long life, etc., but keeps the same bulky size as a corresponding traditional light, by providing one housing with more than one separable LED light including at least one big LED light for an adult and at least one small LED light for children or kids with smaller hands, thus satisfying the need for a traditional bulky size with the additional advantage of providing a multiple built-in LED lights.

The present invention thus provides an LED device with at least one removable LED-light. The LED device may be a flash light, power fail light, LED bar, or other LED device. The at least one removable LED-light can be removed from the main object at any time to offer illumination, the main-object also offering illumination and the main-object and removable-unit(s) being powered by the same power source, which can be any combination of the following parts and accessories: rechargeable batteries, non-rechargeable batteries, energy storage means, solar power, chemical power, mechanical power, generator means, mechanical or electric means to generate power, motion electric generators, or any other means of supplying power to cause the LED-elements to be illuminated and provide predetermined effects, functions, and performance.

The current invention is different from inductively charging LED candle light sets, which lack a main-object having its own illumination function according to a predetermined design for a period of time. The conventional LED candle light set just offers an inductive recharging base and several LED candle lights positioned on the base to recharge without any sort of main-object illumination. The inductive charging system needs some parts and accessories inside the main object and the other LED-light(s) so as to use a magnetic field to charge energy storage means and supply electric signals to the LED-light though circuit means, conductive means and related parts and accessories.

Further features of the current invention can be understood from the following description and appended drawings. It is to be appreciated, however, that the current invention may include variations and modifications, including ones that utilize concepts and features from the inventor's copending or patented patent applications, and that all such variations or modifications should still fall within the scope of the current invention, which is not limited to embodiments included in the current detailed description.

BRIEF DESCRIPTION OF THE DRAWINGS

FIGS. 1 2 are perspective views showing an LED device having a built-in removable LED-light(s).

FIGS. 2-4 are perspective views showing a preferred construction of a main-object having a built-in removable LED-unit(s) or light(s) and an inductive charge system between the main object and the LED-unit(s).

FIGS. 5, 6, 7, and 8 are perspective views showing further details of preferred constructions of the main object and built-in removable LED-light(s), in which the main object may be a power fail night light or emergency light with built-in night light.

DETAILED DESCRIPTION OF THE PREFERRED EMBODIMENTS

The current invention provides an LED device with built-in removable LED-unit(s) having added functions. Portions of the following description have been taken from text boxes included in the original drawings.

FIGS. 1 and 2 show an LED device that includes a main object 1 having built-in removable LED-unit or LED-light(s) 2. In the illustrated preferred embodiment, the main object 1 includes both an LED power fail flashlight 3 and a night light 4 which has extractable prong means 5 to connect with a home electricity system to get power and cause the LED night light 4 to turn on by photo sensor control. The top power fail flashlight 3 will turn on automatically during a power failure, while the built-in removable LED-light(s) is a centerpiece which can be turned-on and turned-off by any desired sensor means, switch means, motion sensor means, or remote control means.

Figure 3:
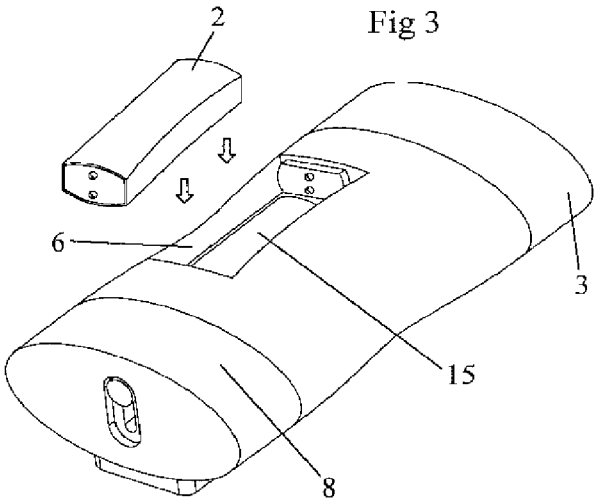
Figure 4:
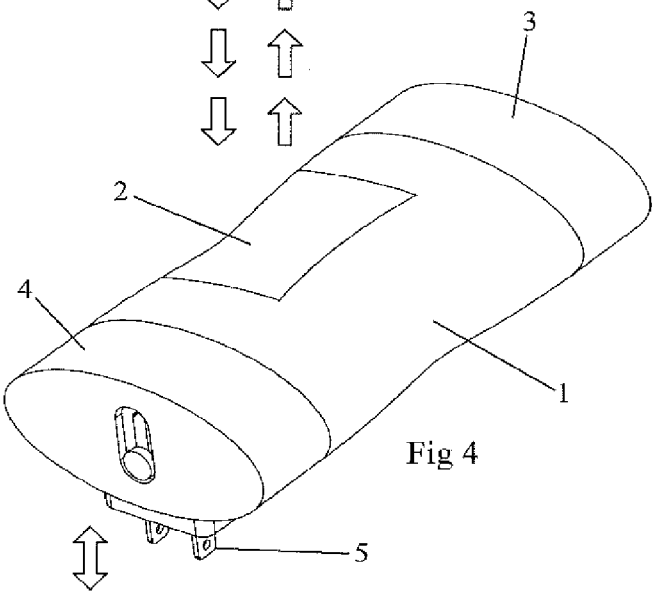
Figures 9, 10, 11, 12, 13:
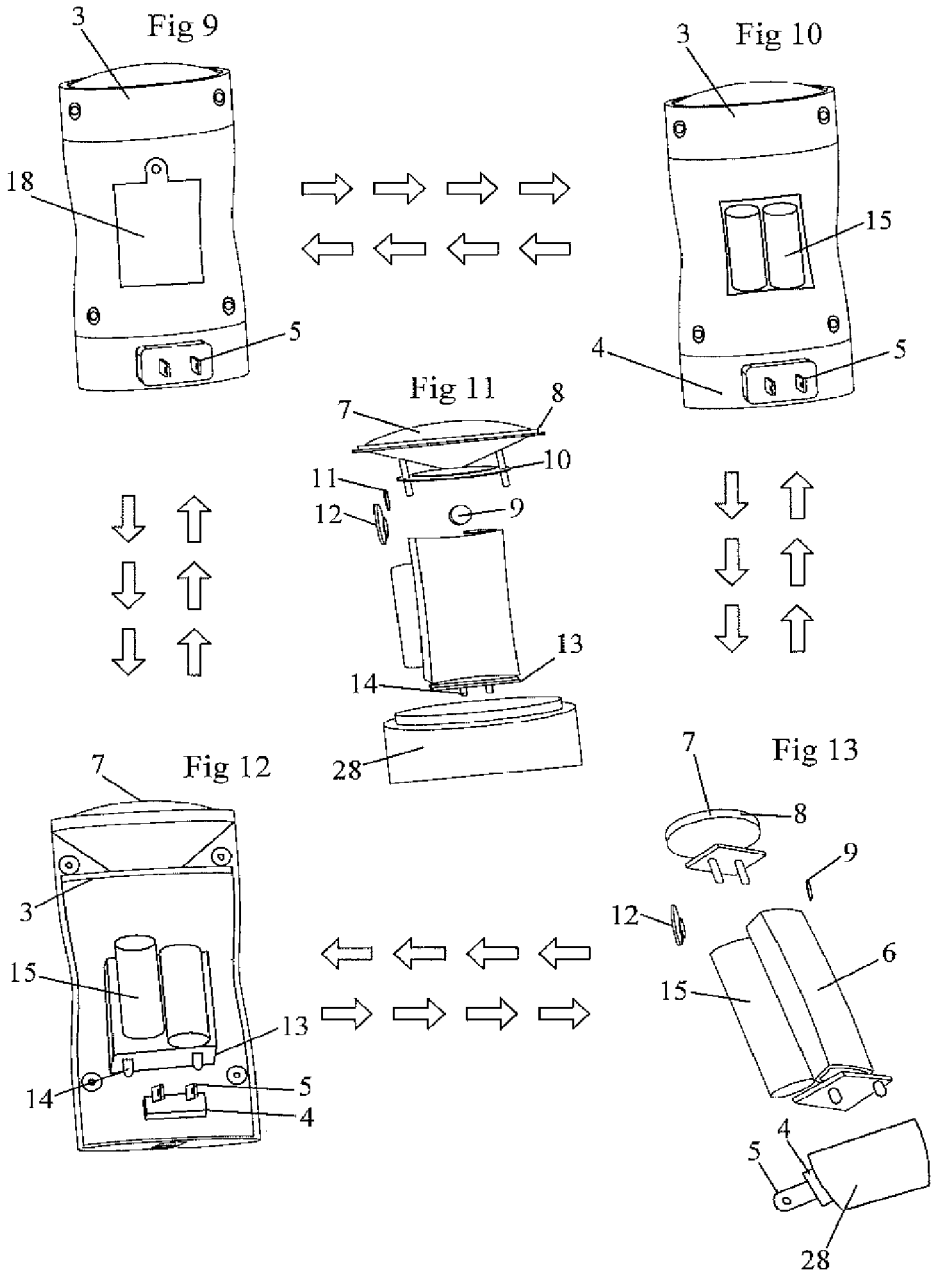
FIGS. 9, 10, 11, 12, and 13 are perspective views showing back sides of the embodiments illustrated in FIGS. 5, 6, 7, 8.

As shown in FIGS. 3 and 4, according to a preferred construction of the main-object 1, the built-in removable LED-units 2 is assembled and disassembled from the main-object by insertion or removal from a compartment 6. When the LED-unit 2 is in the compartment 6 energy storage means inside the LED-unit 2 is inductively charged by inductive charging circuitry in the main object 1 and LED-unit 2 when the prong means 5 are plugged into an electric power supply outlet. At this time, the night light 4 may also illuminated under control of a photosensor for a period of time from dusk to dawn.

FIGS. 5, 6, 7, and 8 show further embodiments of the main object 1 and built-in removable LED-unit or LED-light(s) 2. The top power fail light/flashlight 3 of the main object 1 may include a lens 7 and lens holder/reflector 8, and the main object 1 may further include an opening for a photosensor means 9 for controlling illumination of the night light 4. The flashlight 3 also includes its own circuit board 10 with an LED element and circuitry for the power fail lighting functions, and a switch means 11 and switch cover 12 to enable operation as a flashlight. The night light 4 may have its own printed circuit board 13 for LED elements 14, and a cover 28 that enables light from the night light LED elements 14 to be seen. Both the main object 1 and LED-unit 2 may include respective battery compartments. A battery 15 for the main object 1 is shown in FIG. 7, and battery compartments 16 for the LED-unit 2 are shown in FIG. 8. FIG. 8 also shows the housing 17 of the LED-unit 2, a cover 18 to provide access to the battery compartments 16 to permit battery replacement, a printed circuit board 19 with LED elements 20 for the removable LED-unit, and a stencil or cover 21 for the LED elements 20. It will be appreciated that the illustrated construction is by way of example and not limitation, and that alternative, replaceable, or equivalent-function parts and accessories may be substituted without departing from the scope of invention. FIGS. 9, 10, 11, 12, and 13 show the back side of the constructions illustrated in FIGS. 5, 6, 7, and 8. In addition to the elements described above, FIGS. 9 and 10 show the main object battery compartment 24 and battery compartment cover 25.

Figure 14:
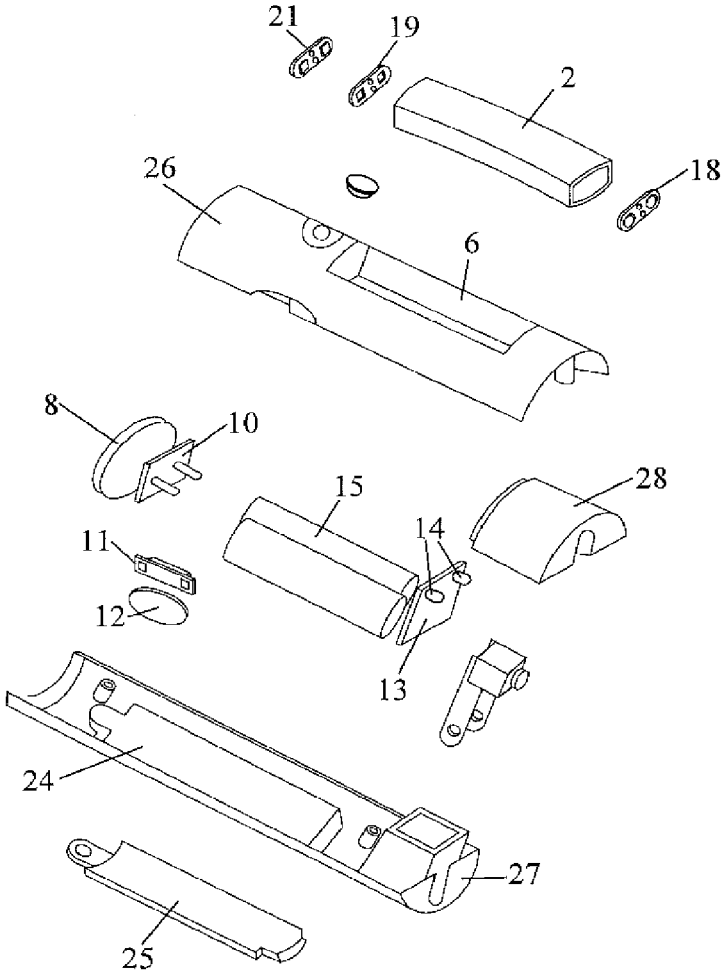
FIGS. 14 15 are exploded perspective views from two different viewing angles showing the embodiments illustrated in FIGS. 5, 6, 7, and 8.
Figure 15:
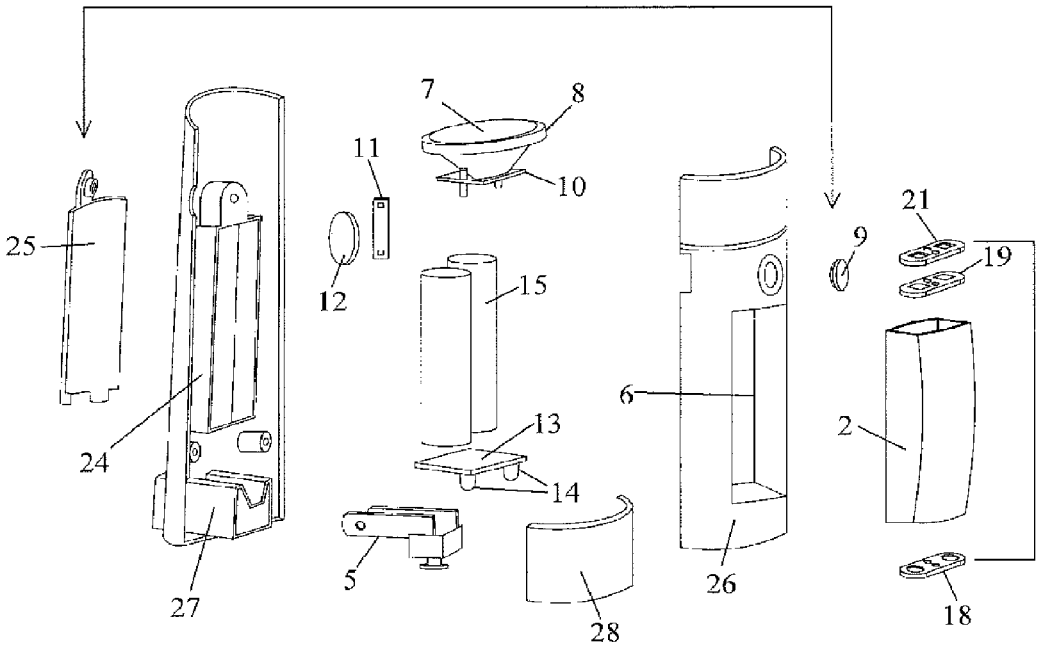

FIGS. 14 and 15 show different viewing angles of the constructions illustrated in FIGS. 5, 6, 7, and 8. As illustrated in FIGS. 14 and 15, the main object 1 has a two part housing including housing halves 26 and 27.

Additional aspects of the present invention are as follows:

The LED device having a built-in removable LED-unit or LED-light(s) may include a variety of different parts and accessories for providing desired illumination functions, including: integrated circuit means (IC), switch means, sensor means, motion sensor means, remote control means, blue tooth means, conductive means, energy storage means, rechargeable batteries, non-rechargeable batteries, other batteries, energy storage means, solar power, chemical power, mechanical power, generator means, mechanical or electric means to generate power, motion electric generator(s), prong-means, resilient conductive means, contact means, screw base means, lamp holder plug means, lamp holder receiving means, conductive-means, wire and plug means, adaptor means, transformer means, or any kind of means which can supply power to illuminate LED-elements according to predetermined effects, functions, and performance.

The at least one removable LED-unit or light(s) 2 can be removed from the main object 1 at any time to offer illumination, and may share power sources with the main object 1 and/or utilize a different power source, and further may including any of the following power-supplying or controlling parts & accessories: integrated circuit means (IC), switch means, sensor means, motion sensor means, remote control means, blue tooth means, conductive means, energy storage means, rechargeable batteries, non-rechargeable batteries, batteries, energy storage means, solar power, chemical power, mechanical power, generator means, mechanical or electric means to generate power, motion electric generator(s), prong-means, resilient conductive means, contact means, screw base means, lamp holder plug means, lamp holder receiving means, conductive-means, wire and plug means, adaptor means, transformer means, or any kind of means which can get power enable illumination of the LED-elements and provide pre-determined effects, functions, and performance.

The main-object 1 has enough space in the housing to build-in at least one removable LED-light and provide main-object and/or removable LED-unit functions that can include any of the following: motion sensor, power fail, emergency light, remote control, blue tooth remote control, timer, countdown, programmable timer, dimmer switch, touch switch, photos sensor switch, switch means, sensor means, IC means, color changing, fade-in and fade-out, night light, or any other LED light functions available from the marketplace to form any of the following devices: a flashlight, power fail light, LED bar, LED device, LED bulb, LED lamp holder, LED fluorescent tube, LED light bar, emergency light, evacuation light, night light, floor light, reading light, wall light, table lamp, desk lamp, indoor lighting, and/or outdoor lighting. The LED LED-element(s) included in the main object 1 or removable light-unit(s) 2 can be any type of LED element, without limitation to specifications, shape, size, brightness, electric-terminal(s), electrode(s), viewing angle, color, and/or power consumption rating, and can be installed, arranged, fixed, or positioned in the main object 1 or removable LED-unit by soldering, surface mounting, or other methods.

The invention claimed is:

1. An LED device, comprising:

a main object and a removable LED-unit removably installed in the main object, wherein the main object includes at least one first LED element for providing a main object illumination function and main object power supply means for supplying power to and controlling turn-on and turn-off of the at least one first LED element, wherein said power supply and control means includes (a) prong means for connecting to an external electrical power source, (b) a first internal power source for supplying power to the at least one first LED element in case of a power failure in the external electrical power source or so that the main object may be used as an emergency light when the prong means are disconnected from said external electrical power source, and at least one of: (c) a switch means for turning the at least one first LED element on and off to achieve predetermined illumination effects, and (d) a sensor means for controlling a turn-on and turn-off of the at least one first LED element; and wherein the removable LED-unit includes at least one second LED element for providing a light-unit illumination function when the LED-unit is removed from the main object and second power supply means including a second internal power source in said removable LED-unit for supplying power to and controlling turn-on and turn-off of the at least one second LED element when said removable LED-unit is removed from said main object.

2. An LED device as claimed in claim 1, wherein the main object includes at least two of said at least one first LED element, one of which provides a night light function and is turned on and off by the sensor means, and another of which provides a flashlight function and is turned on and off by the switch means.

3. An LED device as claimed in claim 1, wherein the second internal power source includes at least one battery.

4. An LED device as claimed in claim 3, wherein the battery of the removable light-unit is inductively charged by the main object when the removable light-unit is installed in the main object.

5. An LED device as claimed in claim 3, wherein the main object includes a compartment for receiving the removable light unit.

6. An LED device as claimed in claim 5, wherein the first internal power source includes at least one battery and the main object further includes a battery compartment in which said at least one battery is installed and means for charging said at least one battery with power supplied by said prong means.

7. An LED device as claimed in claim 6, wherein the second internal power source is a second battery and the main object further includes means for charging the second battery when the removable light-unit is received in said compartment.

8. An LED device, comprising:

a main object and a removable LED-unit removably installed in the main object, wherein the main object includes at least one first LED element for providing a main object illumination function and main object power supply means for supplying power to and controlling turn-on and turn-off of the at least one first LED element, wherein said power supply and control means includes parts and accessories selected from the group consisting of prong means for connecting to an external electrical power source, a first internal power source for supplying power to the at least one first LED element, a switch means for turning the at least one first LED element on and off to achieve predetermined illumination effects, and a sensor means for controlling a turn-on and turn-off of the at least one first LED element; and wherein the removable LED-unit includes at least one second LED element for providing a light-unit illumination function when the LED-unit is removed from the main object and second power supply means including a second internal power source in said removable LED-unit for supplying power to and controlling turn-on and turn-off of the at least one second LED element when said removable LED-unit is removed from said main object, and wherein the main object is a first flashlight having a lens at one end, and wherein the removable light-unit is a second flashlight that is smaller than the first flashlight.

9. An LED device as claimed in claim 8, wherein said prong means are retractable when disconnected from said external electrical power source.

* * * * *